US005589318A

United States Patent [19]

Dale et al.

[11] Patent Number: 5,589,318

[45] Date of Patent: Dec. 31, 1996

[54] HIGH CONTRAST PHOTOGRAPHIC SILVER HALIDE MATERIAL

[75] Inventors: Allison Hazel C. Dale, Mill End; Roger H. Piggin, Abbots Langley; Richard A. Hallett, East Finchley; Paul R. McIntyre, South Oxhey, all of England

[73] Assignee: Eastman Kodak Company, Rochester, N.Y.

[21] Appl. No.: 583,198

[22] Filed: Jan. 4, 1996

Related U.S. Application Data

[63] Continuation of Ser. No. 400,155, Mar. 7, 1995, abandoned.

[30] Foreign Application Priority Data

Apr. 16, 1994 [GB] United Kingdom ..... 9407599
Dec. 21, 1994 [GB] United Kingdom ..... 9425802

[51] Int. Cl.[6] ..... G03C 1/035; G03C 1/08

[52] U.S. Cl. ..... 430/264; 430/567; 430/571; 430/598; 430/604

[58] Field of Search ..... 430/264, 571, 430/425, 604, 598, 567

[56] References Cited

U.S. PATENT DOCUMENTS 3,152,907 10/1964 Godowsky et al. ..... 430/545
3,989,527 11/1976 Locker ..... 430/567
4,276,372 6/1981 Wernicke et al. ..... 430/505
4,812,390 3/1989 Giannesi ..... 430/434
5,210,002 5/1993 Adin ..... 430/264

FOREIGN PATENT DOCUMENTS 0208514 9/1991 European Pat. Off. .
0531014 3/1993 European Pat. Off. .

OTHER PUBLICATIONS

Research Disclosure, Item 17643, Chapters VI and VII, pp. 24–25, Dec. 1978, Kenneth Mason Publications.

Research Disclosure, Item 18431, Aug. 1979, Kenneth Mason Publications.

*Primary Examiner*—Lee C. Wright
*Attorney, Agent, or Firm*—Alfred P. Lorenzo; J. Lanny Tucker

[57] ABSTRACT

A high-contrast photographic material, adapted for use in the field of graphic arts, includes a hydrazide nucleating agent and comprises a silver halide emulsion layer containing silver halide grains which are spectrally sensitized with a non-desorbing sensitizing dye and silver halide grains which are not spectrally sensitized. Preferably, the photographic material also contains a booster compound which enables it to be processed in a developer having a pH of below 11.

10 Claims, 6 Drawing Sheets

HIGH CONTRAST PHOTOGRAPHIC SILVER HALIDE MATERIAL

This is a continuation of application Ser. No. 08/400,155, filed 7 Mar. 1995, now abandoned.

FIELD OF THE INVENTION

The invention relates to high contrast photographic silver halide materials and particularly to those of the graphic arts type.

BACKGROUND OF THE INVENTION

For many years the very high contrast photographic images needed in the graphic arts and printing industries were obtained by developing a 'lith' emulsion (usually high in silver chloride content) in a hydroquinone, low sulphite, 'lith' developer by the process known as infectious development. However, such low sulphite developers are inherently unstable and are particularly inappropriate for machine processing.

More recently, emulsions containing hydrazine nucleating agents have been used and processed in a high pH (about pH 11.5) developer with conventional amounts of sulphite, hydroquinone and possibly metol or a pyrazolidone. While such a process is better than the low sulphite lith process, the developer still has less sulphite than is optimal and a high pH requirement for it to function correctly. Such a solution is not as stable as is desirable. Additionally, high pH solutions are environmentally undesirable because of the care needed in handling and disposing of the effluent.

EP-A-0 531 014 claims high contrast materials sensitive to more than one spectral region comprising one layer of emulsion sensitive to one region and another emulsion layer sensitive to another region. Each spectral sensitivity requires its own emulsion layer. In a comparative test (page 6 lines 9–19), a blend of differently dye sensitised emulsions was used as the sole emulsion layer. This material showed loss of speed, especially if one of the spectral regions is in the infra red. The explanation for this appears to be that the sensitising dyes are being desorbed from their silver halide grain hosts.

EP-A-0 208 514 claims high contrast materials containing a hydrazide wherein there are two distinct populations of grains differing in grain volume. In the comparative examples (outside the scope of the invention claimed) emulsion blending is described. Some of the blends are dye sensitised. However, the blending takes place before the addition of any sensitising dye so that the blended emulsions described have grains which are either all dye sensitised or all not dye sensitised. Blends of sensitised and unsensitised grains are not mentioned.

A further improvement in the area of high contrast materials is the introduction of a lower pH process (below pH 11) using hydrazides active at this low pH together with the use of a contrast booster compound, for example, one of the boosters as described in U.S. Pat. No. 5,316,889 or an amine booster as described in U.S. Pat. Nos. 4,269,929, 4,668,605 and 4,740,452. The hydrazides proposed for use in such materials are described, for example, in U.S. Pat. Nos. 4,278,748, 4,031,127, 4,030,925 and 4,323,643 and in European Patent 0,333,435.

In most photographic materials the type and size of the silver halide grain determines the speed of the material while also affecting the covering power of the silver image formed therefrom. In general smaller sized grains provide higher density and covering power than larger ones. In some materials therefore, there has to be a balance struck between speed and covering power. In high contrast materials another balance between vigorous development and pepper fog (which occurs if development is too vigorous) needs to be achieved.

PROBLEM TO BE SOLVED BY THE INVENTION

The problem is to provide a hydrazide-containing high contrast photographic material which allows savings in sensitising dye, low dye stain and improvements in ease of manufacture while retaining desirable density, low Dmin, high covering power and avoidance of pepper fog.

SUMMARY OF THE INVENTION

A high contrast photographic material comprising a support bearing a silver halide emulsion layer, containing in the emulsion layer or an adjacent hydrophilic colloid layer, a hydrazide nucleating agent characterised in that the emulsion layer comprises silver halide grains which are spectrally sensitised with a non-desorbing sensitising dye and silver halide grains which are not spectrally sensitised.

Both types of silver halide grain contribute to the visible silver image produced by imagewise exposure and development because of the presence of the hydrazide nucleating agent.

More than one type of spectrally sensitised silver halide grain may be utilized; hence grains sensitised to different spectral regions may be present in the emulsion layer.

The silver halide coating is preferably made by blending two or more emulsion melts containing grains of the required spectral sensitivity.

The requirement that the spectral sensitising dye is non-desorbing and thus not able to wander to other silver halide grains can be established in accordance with the following test. The speed of an emulsion, prepared by blending immediately before coating two or more emulsions containing dyes sensitising their grains to radiation of different wavelengths or in which one of the emulsions contains no sensitising dye, is compared to the same emulsion blend held at coating temperature for 15 minutes and then coated. A result where there is a change of speed at 4 above fog less than 0.5 logE, preferably less than 0.15 logE and particularly less than 0.05 logE, indicates that the dyes are non-desorbing as that term is used herein.

ADVANTAGEOU.S. EFFECT OF THE INVENTION

As only a fraction of the total grains need to be spectrally sensitised, laydown of the sensitizing dye(s) is correspondingly only a fraction of that used in conventional nucleated coatings thus leading to considerable cost benefits.

Since the amount of the sensitizing dye(s) used is only a fraction of that used in conventional nucleated coatings, this allows the use of dyes which would not previously have been acceptable due, for example, to post-process dye stain.

Materials sensitive to two or more different wavelengths of radiation with only one emulsion layer, previously thought problematical, can also be made thus giving advantages to the manufacturer in that fewer types of photographic material need to be made. In addition only one emulsion layer has to be coated instead of two or more.

As two or more emulsions of different spectral sensitivity can be included in the same coating, this allows the production of multi-wavelength sensitive products. Such multi-wavelength products give rise to manufacturing cost advantages through both material and inventory reduction The optimisation of the non latent image-forming grains can be extended to include options that would not give acceptable photographic performance if they were the latent image-forming emulsion grains.

As any individual emulsion that forms the latent image need only comprise a small fraction of the total silver laydown, the options for this emulsion can be extended to areas that might normally be precluded because of unacceptable pepper-fog or Dmin.

In conventional nucleated coatings where speed has been limited by the inability to increase the sensitizing dye level without causing unacceptable post-process dye stain, this invention allows the dye rate per mole of silver to be increased whilst reducing or maintaining the dye laydown. This gives speed benefits.

Having only the smaller fraction of the silver composed of a particular spectral sensitivity can often give rise to improvements in linearity of dot reproduction.

Where a particular spectral sensitization requires the use of compounds not necessary in the other emulsion components of the coating, the laydown of these compounds may be reduced. This reduction will lead to cost savings. These compounds may further have undesirable properties, such as high UV Dmin, and their effect can be reduced.

The speed of the non-spectrally sensitized emulsion is not critical to the final photographic speed of the coated product and thus the production of this component requires less stringent control leading to manufacturablity and cost benefits.

Combining the different emulsion grains within one layer gives improvements in process sensitivity over multi-layer graphics nucleated systems.

Certain dyes or other chemicals which may be required for specific spectral sensitizations can inhibit nucleation, giving rise to increased process sensitivity. The reduced laydown of any one grain type can lessen this sensitivity.

As the maximum density of the material is not primarily dependant upon latent image-forming grains, the invention has the advantage that emulsions of grain size above those used in standard nucleated coatings can be used without the need to increase the overall silver laydown.

The present photographic materials are particularly suitable for exposure by red or infra-red laser diodes, light emitting diodes or gas lasers, eg a Helium/Neon or Argon laser.

BRIEF DESCRIPTION OF THE DRAWINGS

In the accompanying drawings.

DETAILED DESCRIPTION OF THE INVENTION

Figure 1:
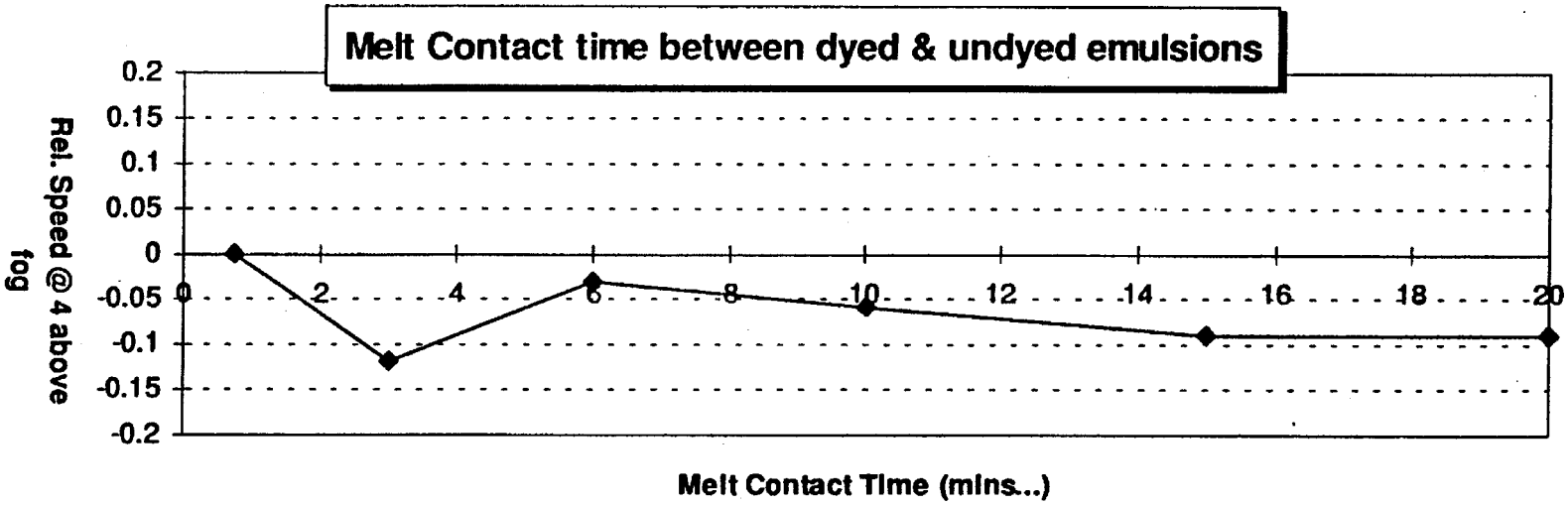
FIGS. 1 to 6 represent the results of Examples 6–10.

The preferred photographic material contains both a hydrazide nucleating agent and a booster compound in the emulsion layer or an adjacent hydrophilic colloid layer, enabling it to be processed in a developer having a pH below 11.

The emulsion layer comprises two or more emulsion grain types. For example, more than one type of latent image-forming grain may be present. Grains sensitive to different regions of the spectrum may thus be used providing a material suitable for more than one exposing radiation type. When there are grains present which are sensitised to distinct wavelength ranges and exposure is to a source of limited wavelength, some of the sensitised grains will not respond to this wavelength and are thus non-latent image forming grains under these conditions of use.

All the emulsion grains are preferably chemically sensitised, for example with both sulphur and gold.

The latent image-forming grains can be bromoiodide, chlorobromoiodide, bromide, chlorobromide, chloroiodide or chloride. They should preferably be spectrally sensitized.

The non latent image-forming grains can be bromoiodide, chloroiodide, chlorobromoiodide, bromide, chlorobromide, or chloride.

Both types of grain may also contain dopants as more fully described below.

Preferably both the latent image-forming and the non latent image-forming grains comprise at least 50 mole percent chloride, preferably from 50 to 100 mole percent chloride.

The grain size of the latent image-forming and non-latent image-forming grains preferably ranges independently between 0.05 and 1.0 in equivalent circle diameter, preferably 0.05 to 0.5 and most preferably 0.05 to 0.35 microns. The grain populations in the emulsion layer may have the same or differing grain sizes.

As is known in the graphic arts field the silver halide grains may be doped with Rhodium, Ruthenium, Iridium or other Group VIII metals either alone or in combination. The grains may be mono- or poly-disperse.

Preferably the silver halide grains are doped with one or more Group VIII metal at levels in the range $10^{-9}$ to $10^{-3}$, preferably $10^{-6}$ to $10^{-3}$, mole metal per mole of silver. The preferred Group VIII metals are Rhodium and/or Iridium.

The emulsions employed and the addenda added thereto, the binders, supports, etc. may be as described in Research Disclosure Item 308119, December 1989 published by Kenneth Mason Publications, Emsworth, Hants, United Kingdom.

The hydrophilic colloid may be gelatin or a gelatin derivative, polyvinylpyrrolidone or casein and may contain a polymer. Suitable hydrophilic colloids and vinyl polymers and copolymers are described in Section IX of Research Disclosure Item 308119, December 1989 published by Kenneth Mason Publications, Emsworth, Hants, United Kingdom. Gelatin is the preferred hydrophilic colloid.

The present photographic materials may also contain a supercoat hydrophilic colloid layer which may also contain a vinyl polymer or copolymer located as the last layer of the coating (furthest from the support). It may contain some form of matting agent.

The vinyl polymer or copolymer is preferably an acrylic polymer and preferably contains units derived from one or more alkyl or substituted alkyl acrylates or methacrylates, alkyl or substituted alkyl acrylamides or acrylates or acrylamides containing a sulphonic acid group.

Suitable hydrophilic binders and vinyl polymers and copolymers are described in Section IX of Research Disclosure Item 308119, December 1989 published by Kenneth Mason Publications, Emsworth, Hants, United Kingdom.

The present emulsion layers are preferably formed by dye sensitising emulsions with a single dye and then combining the differently spectrally sensitised emulsions together with any non-spectrally sensitised emulsion being used. The blending can be done immediately before coating but this is not necessary as the present blended emulsions are stable for at least 20 minutes at coating temperatures.

Any hydrazine compound may be used that functions as a nucleator and is preferably capable of providing, with a booster, a high contrast image on development at a pH below 11.

The hydrazine compound is incorporated in the photographic element, for example, it can be incorporated in a silver halide emulsion layer. Alternatively, the hydrazine compound can be present in a hydrophilic colloid layer of the photographic element, preferably a hydrophilic colloid layer which is coated to be adjacent to the emulsion layer in which the effects of the hydrazine compound are desired. It can, of course, be present in the photographic element distributed between or among emulsion and hydrophilic colloid layers, such as undercoating layers, interlayers and overcoating layers.

Such hydrazine compounds may have the formula:

$R^{+}$—NHNHCHO wherein $R^{+}$ is a phenyl nucleus having a Hammett sigma value-derived electron withdrawing characteristic of less than +0.30.

In the above formula, $R^{+}$ can take the form of a phenyl nucleus which is either electron donating (electropositive) or electron withdrawing (electronegative); however, phenyl nuclei which are highly electron withdrawing produce inferior nucleating agents. The electron withdrawing or electron donating characteristic of a specific phenyl nucleus can be assessed by reference to Hammett sigma values.

Preferred phenyl group substituents are those which are not electron withdrawing. For example, the phenyl groups can be substituted with straight or branched chain alkyl groups (e.g., methyl, ethyl, n-propyl, isopropyl, n-butyl, isobutyl, n-hexyl, n-octyl, tert-octyl, n-decyl, n-dodecyl and similar groups). The phenyl groups can be substituted with alkoxy groups wherein the alkyl moieties thereof can be chosen from among the alkyl groups described above.

The phenyl groups can also be substituted with acylamino groups. Illustrative acylamino groups include acetylamino, propanoylamino, butanoylamino, octanoylamino, benzoylamino, and similar groups.

In one particularly preferred form the alkyl, alkoxy and/or acylamino groups are in turn substituted with a conventional photographic ballast, such as the ballasting moieties of incorporated couplers and other immobile photographic emulsion addenda. The ballast groups typically contain at least eight carbon atoms and can be selected from both aliphatic and aromatic relatively unreactive groups, such as alkyl, alkoxy, phenyl, alkylphenyl, phenoxy, alkylphenoxy and similar groups.

The alkyl and alkoxy groups, including ballasting groups, if any, preferably contain from 1 to 20 carbon atoms, and the acylamino groups, including ballasting groups, if any, preferably contain from 2 to 21 carbon atoms. Generally, up to about 30 or more carbon atoms in these groups are contemplated in their ballasted form. Methoxyphenyl, tolyl (e.g., p-tolyl and m-tolyl) and ballasted butyramidophenyl nuclei are specifically preferred.

Examples of the specifically preferred hydrazine compounds are the following:

1-Formyl-2-(4-[2-(2,4-di-tert-pentyl-phenoxy)-butyramido]phenyl)hydrazine,

1-Formyl-2-phenylhydrazine,

1-Formyl-2-(4-methoxylphenyl)hydrazine,

1-Formyl-2-(4-chlorophenyl)hydrazine,

1-Formyl-2-(4-fluorophenyl)hydrazine,

1-Formyl-2-(2-chlorophenyl)hydrazine, and

1-Formyl-2-(p-tolyl)hydrazine.

The hydrazine may also comprise an adsorption promoting moiety. Hydrazides of this type contain an unsubstituted or mono-substituted divalent hydrazo moiety and an acyl moiety. The adsorption promoting moiety can be chosen from among those known to promote adsorption of photographic addenda to silver halide grain surfaces. Typically, such moieties contain a sulphur or nitrogen atom capable of complexing with silver or otherwise exhibiting an affinity for the silver halide grain surface. Examples of preferred adsorption promoting moieties include thioureas, heterocyclic thioamides and triazoles. Exemplary hydrazides containing an adsorption promoting moiety include:

1-[4-(2-formylhydrazino)phenyl]-3-methyl thiourea,

3-[4-(2-formylhydrazino)phenyl-5-(3-methyl-2-benzoxazolinylidene)rhodanine-6-([4-(2-formylhyrazino)phenyl]ureylene)-2-methylbenzothiazole, N-(benzotriazol-5-yl)-4-(2-formylhydrazino)-phenylacetamide, and N-(benzotriazol-5-yl)-3-(5-formylhydrazino-2-methoxyphenyl)propionamide and N-2-(5,5-dimethyl-2-thiomidazol-4-yl-idenimino)ethyl-3-[5-(formylhydrazino)-2-methoxyphenyl]propionamide.

An especially preferred class of hydrazine compounds for use in the elements of this invention are sulfonamido-substituted hydrazines having one of the following structural formulae:

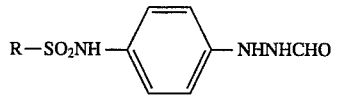

or

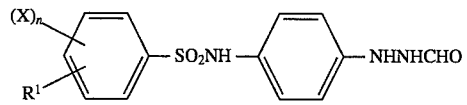

wherein:

R is alkyl having from 6 to 18 carbon atoms or a heterocylic ring having 5 or 6 ring atoms, including ring atoms of sulphur or oxygen;

$R^1$ is alkyl or alkoxy having from 1 to 12 carbon atoms;

X is alkyl, thioalkyl or alkoxy having from 1 to about 5 carbon atoms; halogen; or —$NHCOR^2$, —$NHSO_2R^2$, —$CONR^2R^3$ or —$SO_2R^2R^3$ where $R^2$ $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to 4 carbon atoms, halogen atoms (e.g. chlorine and fluorine) or —$NHCOR^2$— or —$NHSO_2R^2$— where $R^2$ is as defined above. Preferred R alkyl groups contain from 8 to 16 carbon atoms since alkyl groups of this size impart a greater degree of insolubility to the hydrazine nucleating agents and thereby reduce the tendency of these agents to be leached during development from the layers in which they are coated into developer solutions.

Heterocyclic groups represented by R include thienyl and furyl, which groups can be substituted with alkyl having from 1 to 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to 4 carbon atoms, halogen atoms (e.g. chlorine or fluorine); or —$NHCOR^2$ or —$NHSO_2R^2$ where $R^2$ is as defined above. Preferred alkyl or alkoxy groups contain from 1 to 5 carbon atoms in order to impart sufficient insolubility to the hydrazine nucleating agents to reduce their tendency to being leached out of the layers in which they are coated by developer solution.

Alkyl, thioalkyl and alkoxy groups which are represented by X contain from 1 to 5 carbon atoms and can be straight or branched chain. When X is halogen, it may be chlorine, fluorine, bromine or iodine. Where more than one X is present, such substituents can be the same or different.

Particularly preferred nucleators have the following formulae:

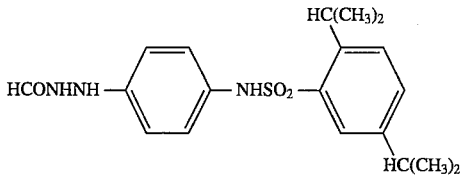

N1

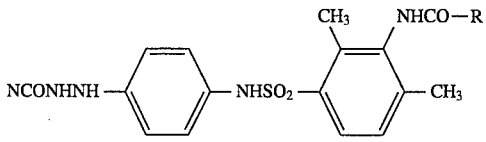

N2

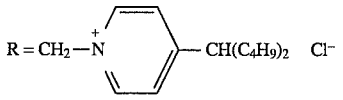

The present materials may also contain a booster compound enabling the desired high contrast when development occurs at a pH below 11.

One class of such boosters are amines which are described in U.S. Pat. No. 4,975,354 wherein they are defined as an amino compound which:

(1) comprises at least one secondary or tertiary amino group, (2) contains within its structure a group comprised of at least three repeating ethyleneoxy units, and (3) has an n-octanol/water partition coefficient (log P) of at least one, preferably at least three, and most preferably at least four, log P being defined by the formula:

$$\log P = \log \frac{[X_{octanol}]}{[X_{water}]}$$

wherein X is the concentration of the amino compound.

Included within the scope of the amino compounds which may be utilised in this invention are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amine boosters are compounds of at least 20 carbon atoms. It is also preferred that the ethyleneoxy units are directly attached to the nitrogen atom of a tertiary amino group.

Preferably the partition coefficient is at least three, most preferably at least 4.

Preferred amino compounds for the purposes of this invention are bis-tertiary-amines which have a partition coefficient of at least three and a structure represented by the formula:

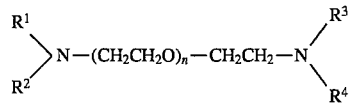

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another preferred group of amino compounds are bis-secondary amines which have a partition coefficient of at least three and a structure represented by the formula:

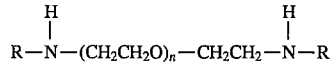

wherein n is an integer with a value of 3 to 50, and more preferably 10 to 50, and each R is, independently, a linear or branched, substituted or unsubstituted, alkyl group of at least 4 carbon atoms. Particular amine boosters are listed in European Specification 0,364,166.

Other types of booster are compounds having one of the formula:

$$Y((X)_n—A—B)_m$$

wherein

Y is a group which adsorbs to silver halide,

X is a bivalent linking group composed of hydrogen, carbon, nitrogen and sulphur atoms, A is a bivalent linking group.

B is an amino group which may be. substituted, an ammonium group or a nitrogen-containing heterocyclic group, m is 1, 2 or 3 and n is 0 or 1, or of the formula:

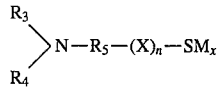

wherein $R_3$ and $R_4$ are each hydrogen or an aliphatic group, or $R_3$ and $R_4$ may together form a ring, $R_5$ is a bivalent aliphatic group, X is a bivalent heterocyclic ring having at least one nitrogen, oxygen or sulphur atom as heteroatom, n is 0 or 1, and M is hydrogen or an alkali metal atom, an alkaline earth metal atom, a quaternary ammonium group, a quaternary phosphonium group or an amidino group, x is 1 when when M is a divalent atom;

said compound optionally being in the form of an addition salt.

The sensitising dye may have one of the general formulae:

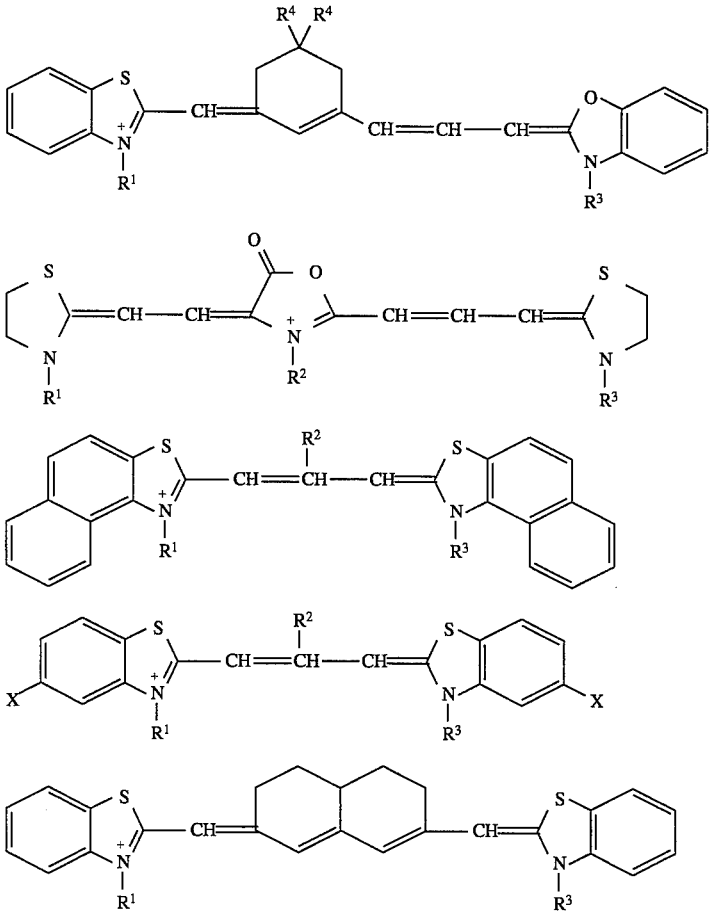

wherein $R^1$, $R^2$ and $R^3$ represent an alkyl group which may be substituted, for example with an acid water-solubilising group, for example a group carboxy or sulphur and R4 is an alkyl group of 1–4 carbon atoms.

X is a halogen, for example chloro, bromo, iodo or fluoro.

The present photographic materials preferably contain an antihalation layer on either side of the support. Preferably it is located on the opposite side of the support from the emulsion layer. In a preferred embodiment an antihalation dye is contained in the hydrophilic colloid underlayer. The dye may also be dissolved or dispersed in the underlayer. Suitable dyes are listed in the Research Disclosure mentioned above.

The light-Sensitive silver halide contained in the photographic elements can be processed following exposure to form a visible image by associating the silver halide with an aqueous alkaline medium in the presence of a developing agent contained in the medium or the element. It is a distinct advantage of the embodiment of the present invention which contains a booster that the described photographic elements can be processed in conventional developers as opposed to specialised developers conventionally employed in conjunction with lithographic photographic elements to obtain very high contrast images. When the photographic elements contain incorporated developing agents, the elements can be processed in the presence of an activator, which can be identical to the developer in composition, but otherwise lacking a developing agent.

Very high contrast images can be obtained at pH values below 11, preferably in the range of from 10.2 to 10.6, preferably in the range of 10.3 to 10.5, and especially at 10.4.

The developers are typically aqueous solutions, although organic solvents, such as diethylene glycol, can also be included to facilitate the solution of organic components. The developers contain one or a combination of conventional developing agents, such as a polyhydroxybenzene, aminophenol, paraphenylenediamine, ascorbic acid, pyrazolidone, pyrazolone, pyrimidine, dithionite, hydroxylamine or other conventional developing agents.

It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulphate can be incorporated into the developer. Chelating and sequestering agents, such as ethylene-diaminetetraacetic acid or its sodium salt, can be present. Generally, any conventional developer composition can be employed in the practice of this invention. Specific illustrative photographic developers are disclosed in the Handbook of Chemistry and Physics, 36th Edition, under the title "Photographic Formulae" at page 3001 et seq. and in Processing Chemicals and Formulas, 6th Edition, published by Eastman Kodak Company (1963). The photographic elements can, of course, be processed with conventional developers for lithographic photographic elements, as illustrated by U.S. Pat. No. 3,573,914 and UK Patent No. 376,600.

The following Examples are included for a better understanding of the invention.

EXAMPLE 1

The photographic element of this example consisted of a polyethylene terephthalate support (with an antihalation layer on its rear surface) on which was coated a blended emulsion layer, an interlayer and a protective supercoat.

The supercoat contained matte beads and surfactants.

The interlayer contained the amine booster compound of the formula:

$$(C_3H_7)_2N(CH_2OCH_2O)_{14}CH_2CH_2N(C_3H_7)_2$$

and a latex copolymer of methyl acrylate, 2-acrylamido-2-methylpropanesulphonic acid and the sodium salt of 2-acetoxyethylmethacrylate (88:5:7 by weight).

The basic emulsion grains used in this example were all the same. They consisted of 70:30 chlorobromide cubic monodispersed grains (0.13 μm edge length) doped with ammonium pentachlororhodate. This emulsion was chemically sensitized using N,N'-dicarboxy-methyl-N,N'-dimethylthiourea disodium salt and potassium tetrachloroaurate with a 25 minute digestion at 65° C.

The spectrally sensitised emulsion melt (Melt A) contained a sensitizing dye of the formula:

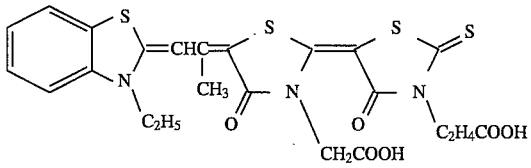

peaking in the 670 nm region, antifoggants and latex copolymer. This melt also contained the nucleator compound (structure I):

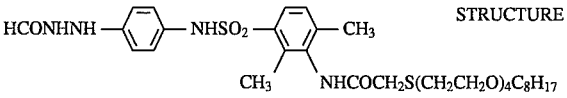

STRUCTURE I

The non-spectrally sensitized emulsion melt (Melt B) was prepared in the same way as melt A but the sensitizing dye was omitted.

Coatings were prepared having the following emulsion layers:

| Coating No | Emulsion Blend | Coating weight ($Ag/m^2$) |
|---|---|---|
| 1 (Control) | Melt A | 2.8 |
| 2 (Invention) | Melt A | 1.4 |
| | Melt B | 1.4 |
| 3 (Invention) | Melt A | 0.84 |
| | Melt B | 1.96 |
| 4 (Invention) | Melt A | 0.28 |
| | Melt B | 1.96 |

[Note: the overall silver level in coatings 1 to 3 remains constant at 2.8 $gAg/m^2$.]

The above coatings were evaluated by exposing using a 670 nm laser diode device generating a 0.08ND increment wedge and then processed in KODAK® RA2000 Developer (diluted 1+2) at 35° C. for 30 seconds. The results are shown in the table below.

| Coating | Dmin | Dmax | Speed (0.6 above fog) |
|---|---|---|---|
| 1 | 0.032 | 5.78 | 219.7 |
| 2 | 0.024 | 5.72 | 216.8 |
| 3 | 0.023 | 5.31 | 217.5 |
| 4 | 0.019 | 4.90 | 207.4 |

The reduction in Dmin seen here is due to lower post process dye stain.

EXAMPLE 2

Film coatings were prepared as described in Example 1.

Melt C consisted of a 70:30 chlorobromide cubic monodispersed emulsion (0.18 μm edge length) doped with ammonium pentachlororhodate. This emulsion was chemically sensitized using N,N'-dicarboxy-methyl-N,N'-dimethylthiourea disodium salt and potassium tetrachloroaurate with a 25 minute digestion at 65° C. It was then spectrally sensitized using a dye of the formula:

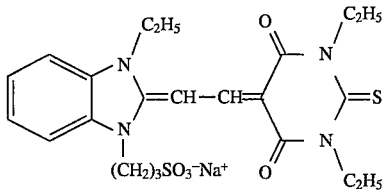

peaking in the 488 nm region. Other addenda included antifoggants and the latex copolymer of Example 1.

Melt D consisted of a 70:30 chlorobromide cubic monodispersed emulsion (0.13 μm edge length) doped with ammonium pentachlororhodate. This emulsion was chemically sensitized using N,N'-dicarboxy-methyl-N,N'-dimethylthiourea disodium salt and potassium tetrachloroaurate with a 25 minute digestion at 65° C. It was then spectrally sensitized using a combination of dyes of the formulae:

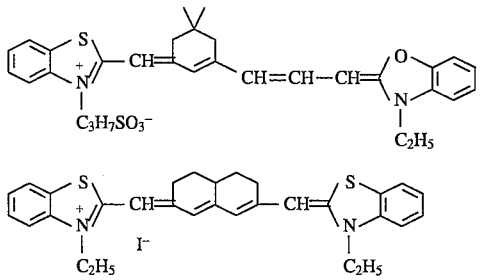

peaking in the infra-red region. The emulsion also contained a supersensitiser of the formula:

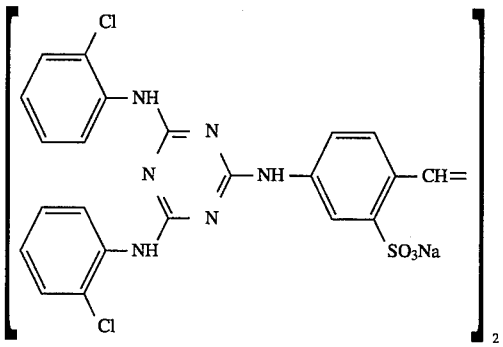

and an absorber dye of the formula:

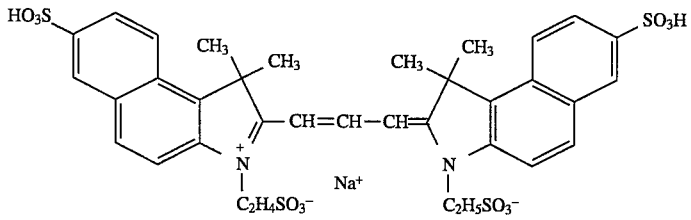

Other addenda included antifoggants and the latex copolymer as used in Example 1. These last additions can lead to increased UV Dmin after processing.

Coatings were prepared having the following emulsion layers:

| Coating No | Emulsion Blend | Coating weight ($Ag/m^2$) |
|---|---|---|
| 5 (Control) | Melt C | 3.3 |
| 6 (Control) | Melt D | 3.3 |
| 7 (Invention) | Melt C | 2.31 |
| | Melt D | 0.99 |

[Note: the overall silver level in coatings 5 to 7 remains constant at 3.3 gAg/m2.]

The above coatings were evaluated by exposing as follows:

Coatings 5 & 7: 0.1 increment step wedge with a $10^{-6}$s flash sensitometer fitted with a P11 filter (simulates an argon-ion laser exposing source).

Coatings 6 & 7: an infra-red laser source generating a 0.1 increment wedge.

In each case the coatings were then processed in KODAK® RA2000 Developer (diluted 1+2) at 35° C. for 30 seconds. The results are shown in the table below.

| Coating | P11 Speed (4 above fog) | IR laser Speed (4 above fog) | UV Dmin |
|---|---|---|---|
| 5 | 1.14 | N/A | 0.038 |
| 6 | N/A | 1.12 | 0.064 |
| 7 | 1.14 | 1.04 | 0.045 |

The speeds in each case are suited to the exposing sources often used and the UV Dmin advantage of coating 7 over coating 6 is clearly demonstrated.

On practical evaluation of these coatings using appropriate imagesetter and scanner devices excellent image quality was obtained. A further advantage has been demonstrated in the case of coating 7 versus coating 6. The linearity, as judged by the actual halftone dot size obtained when a 50% dot is written to the film, is seen to be greatly improved. The results obtained upon exposure of a 50% dot using an infra-red imagesetter are shown below:

| Coating | Dot size as measured |
|---|---|
| 7 | 50.4% |
| Control (Coating 6) | 52.3% |

EXAMPLE 3

Film coatings were prepared as described in Example 1.

Melt E consisted of a 70:30 chlorobromide cubic monodispersed emulsion (0.18 μm edge length) doped with ammonium pentachlororhodate. This emulsion was chemically sensitized using N,N'-dicarboxy-methyl-N,N'-dimethylthiourea disodium salt and potassium tetrachloroaurate with a 25 minute digestion at 65° C. It was then spectrally sensitized using a dye of the formula:

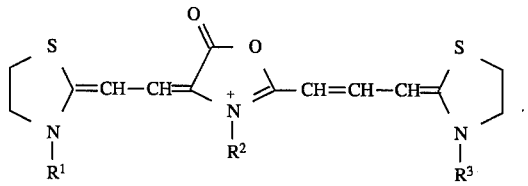

peaking in the 633 nm region. Other addenda included antifoggants and latex copolymer as used in Example 1. The nucleator compound (structure I) was also included in this melt.

Melt F consisted of a 70:30 chlorobromide cubic monodispersed emulsion (0.13 μm edge length) doped with ammonium pentachlororhodate. This emulsion was chemically sensitized using N,N'-dicarboxy-methyl-N,N'-dimethylthiourea disodium salt and potassium tetrachloroaurate with a 25 minute digestion at 65° C. Other addenda included potassium iodide, antifoggants and the latex copolymer as used in Example 1. The nucleator compound (structure I) was also included in this melt.

Coatings were prepared having the following emulsion layers:

| Coating No | Emulsion Blend | Coating weight ($Ag/m^2$) |
|---|---|---|
| 8 (Control) | Melt E | 2.6 |
| 9 (Invention) | Melt E | 0.78 |
| | Melt F | 1.82 |

[Note: the overall silver level in coatings 8 & 9 remains constant at 2.6 gAg/m2.]

The above coatings were evaluated by exposing using a helium-neon laser source generating a 0.1 increment wedge. The coatings were then processed in KODAK® RA2000

Developer (diluted 1+2) at 35° C. for 30 seconds. The results are shown in the table below.

| Coating | Dmax |
|---|---|
| 8 | 4.44 |
| 9 | 4.93 |

This example demonstrates that the invention can increase the Dmax obtainable without increasing the silver laydown.

EXAMPLE 4

Film coatings were prepared as described in Example 1.

Melt G consisted of a 70:30 chlorobromide cubic monodispersed emulsion (0.18 μm edge length) uniformly doped with ammonium pentachlororhodate. This emulsion is chemically sensitized using N,N'-dicarboxy-methyl-N,N'-dimethylthiourea disodium salt and potassium tetrachloroaurate with a 25 minute digestion at 65° C. It was then spectrally sensitised using 353 mg/Agmole of the sensitizing dye of the formula:

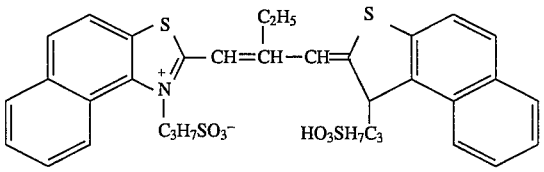

and 530 mg/Agmole of the sensitizing dye of the formula:

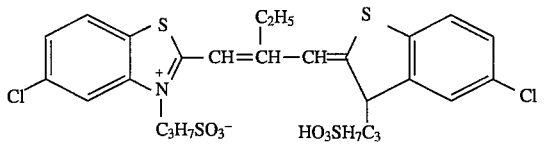

Other addenda included antifoggants and the latex copolymer as used in Example 1.

Melt H consisted of a 70:30 chlorobromide cubic monodispersed emulsion (0.13 μm edge length) doped with ammonium pentachlororhodate. This emulsion is chemically sensitized using N,N'-dicarboxy-methyl-N,N'-dimethylthiourea disodium salt and potassium tetrachloroaurate with a 25 minute digestion at 65 degrees centigrade. The melt was prepared in the same fashion as melt G with the omission of the sensitizing dyes and the potassium iodide.

Melt I consisted of a 70:30 chlorobromide cubic monodispersed emulsion (0.18 μm edge length) uniformly doped with ammonium pentachlororhodate. This emulsion is chemically sensitized using N,N'-dicarboxy-methyl-N,N'-dimethylthiourea disodium salt and potassium tetrachloroaurate with a 25 minute digestion at 65° C. Other addenda included were 100 mg/Agmole of the sensitizing dye of the formula:

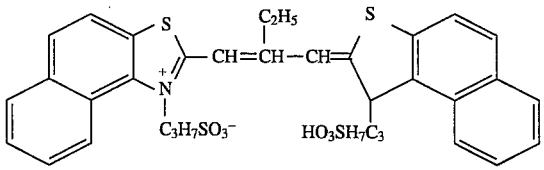

and 150 mg/Agmole of the sensitizing dye of the formula:

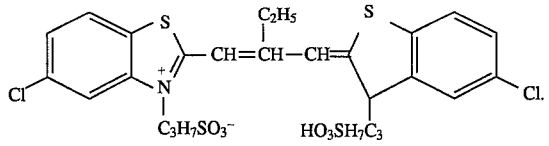

Other addenda included antifoggants and the latex copolymer as used in Example 1.

Coatings were prepared having the following emulsion layers:

| Coating No | Emulsion Blend | Coating weight ($Ag/m^2$) |
|---|---|---|
| 10 (Control) | Melt I | 3.3 |
| 11 (Invention) | Melt G | 0.98 |
| | Melt H | 2.37 |

[Note: the overall silver level in coatings 10 & 11 remains constant at 3.3 $gAg/m^2$ and the overall dye laydowns are also the same.]

The above coatings were evaluated by exposing through a 0.1 increment step wedge with a $10^{-6}$s flash sensitometer fitted with a W29 filter and then processed in Kodak™ RA2000 Developer (diluted 1+2) at 35° C. for 30 seconds. The results are shown below:

| Coating | Dmin | Speed (0.6 above fog) |
|---|---|---|
| 10 | 0.049 | 0.86 |
| 11 | 0.049 | 1.23 |

As a further comparison a coating was prepared in which melt G was coated at a laydown of 3.3 $gAg/m^2$. This coating had a Dmin of 0.134 due to the high level of post-process dye stain.

This combination of dyed and undyed emulsions allows a speed increase to be realised without the penalty of high minimum density that would be a consequence of increasing the dye level on a coating containing only one emulsion component, due to the staining nature of the dyes employed.

EXAMPLE 5

This example demonstrates that a multi-wavelength product is not limited to only two wavelengths.

Film coatings were prepared as described in Example 1 to provide differently spectrally sensitized materials.

Melt J consisted of a 70:30 chlorobromide cubic monodispersed emulsion (0.18 μm edge length) doped with ammonium pentachlororhodate. This emulsion was chemically sensitized using N,N'-dicarboxy-methyl-N,N'-dimethylthiourea disodium salt and potassium tetrachloroaurate with a 25 minute digestion at 65° C. It was then spectrally sensitized using a dye of the formula:

STRUCTURE 2

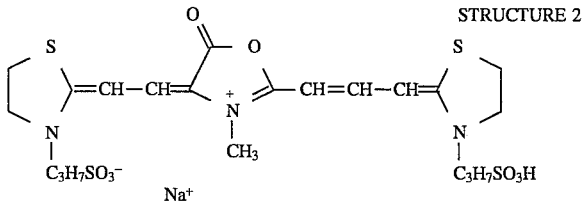

peaking in the 633 nm region. Other addenda included antifoggants and latex copolymer.

Melt K consisted of a 70:30 chlorobromide cubic monodispersed emulsion (0.18 μm edge length) doped with ammonium pentachlororhodate. This emulsion was chemically sensitized using N,N'-dicarboxy-methyl-N,N'-dimethylthiourea disodium salt and potassium tetrachloroaurate with a 25 minute digestion at 65° C. It was then spectrally sensitized using a dye of the formula:

STRUCTURE 3

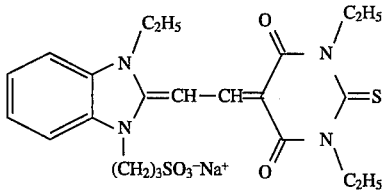

peaking in the 488 nm region. Other addenda included antifoggants and the latex copolymer of Example 1.

Melt L consisted of a 70:30 chlorobromide cubic monodispersed emulsion (0.13 μm edge length), doped with ammonium pentachlororhodate. This emulsion was chemically sensitized using N,N'-dicarboxy-methyl-N,N'-dimethylthiourea disodium salt and potassium tetrachloroaurate with a 25 minute digestion at 65° C. It was then spectrally sensitized using a dye of the formula:

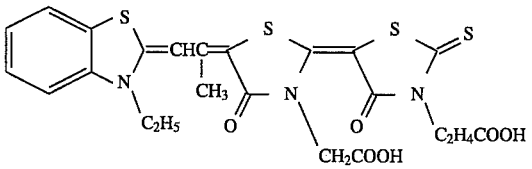

peaking in the 670 mn region. Other addenda included antifoggants and the same latex copolymer.

Coatings were prepared having the following emulsion layers:

| Coating No | Emulsion Blend | Coating weight ($Ag/m^2$) |
|---|---|---|
| 12 (Control) | Melt J | 2.6 |
| 13 (Control) | Melt K | 2.6 |
| 14 (Control) | Melt L | 2.6 |
| 15 (Invention) | Melt J | 0.78 |
| | Melt K | 1.04 |
| | Melt L | 0.78 |

[Note: the overall silver level in coatings 12 to 15 remains constant at 2.6 $gAg/m^2$.]

The above coatings were evaluated by exposing using the devices shown:

Coatings 12 & 15: a helium neon laser source generating a 0.1 increment wedge.

Coatings 13 & 15: 0.1 increment step wedge with a $10^{-6}$s flash sensitometer fitted with a P11 filter. (Simulates an argon-ion laser source).

Coatings 14 & 15: a 670 nm laser diode device generating a 0.08 increment wedge.

In each case the coatings were then processed in KODAK® RA2000 Developer (diluted 1+2) at 35° C. for 30 seconds. The results are shown in the table below.

| Coating | HeNe Speed | "Argon-ion" Speed | 670 nm Laser Diode Speed |
|---|---|---|---|
| 12 | 202.0 | | |
| 13 | | 175.2 | |
| 14 | | | 244.8 |
| 15 | 195.2 | 172.8 | 244.0 |

The speeds in each case are suited to commonly used exposing sources.

EXAMPLES 6–10

Dye Suitability Tests

EXAMPLE 6

Melts A & B were prepared as detailed below. Mixing melts A a B will give a 1:1 blend of unsensitised and dye sensitised grains. The melts were mixed together (time=0) and then coatings were made from this blend at measured intervals. As a control, a coating was prepared in which melts identical to A & B were pumped separately to a mixing chamber situated immediately prior to the coating hopper. This represents the shortest melt contact time.

Both melts A & B used a chlorobromide cubic monodisperse emulsion having an edgelength of 0.18 μm with a suitable chemical sensitization.

Melt A: The emulsion was spectrally sensitized using the dye of the formula:

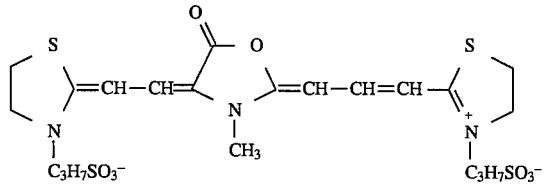

which peaks in the 633 nm region. Other addenda included antifoggants, latex copolymer, and a nucleator compound of the formula:

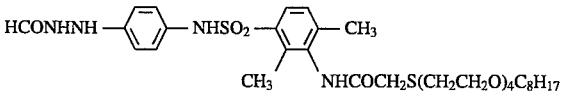

Melt B: This melt was prepared identically to melt A but omitting the sensitizing dye.

The melt sizes for A & B were in the molar ratio 1:1.

The coatings were prepared using a polyethylene terephthalate support (with pelloid) on which was coated the emulsion layer, an interlayer and a supercoat. The emulsion layer was coated from the 1:1 mix of melts A & B to give a silver laydown of 2.8 $g/m^2$. The interlayer contained an amine booster compound of the formula:

$$(C_3H_7)_2N(CH_2OCH_2O)_{14}CH_2CH_2N(C_3H_7)_2,$$

and latex copolymer. The supercoat comprised gelatin, matte beads, and surfactants.

The series of coatings were exposed through a 0.1 increment step wedge with a $10^{-6}$s flash sensitometer. A Wr29 filter was used to ensure that only the red sensitive grains were exposed.

The coatings were then processed in KODAK RA2000 Developer (diluted 1+2) at 35° C. for 30 seconds.

| Time delay before coating Dual melted | Speed @ Den = 4 above fog (Rel. to control) |
|---|---|
| 3 | −0.12 |
| 6 | −0.03 |
| 10 | −0.06 |
| 15 | −0.09 |
| 20 | −0.09 |

These data are shown in graphical form in FIG. 1 of the accompanying drawings.

EXAMPLE 7

Melts C & D were prepared and coated in the same manner as described above and used the same emulsion substrate. In this case the spectral sensitization used a combination of two dyes peaking in the infrared region. The structures of these dyes are shown below (structures 4 & 5). The molar ratio of melt C (dyed) and melt D (undyed) was 1:4.

STRUCTURE 4

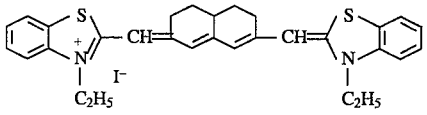

STRUCTURE 5

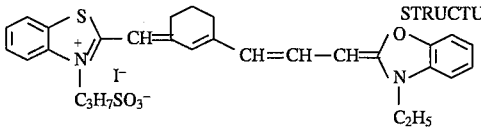

The series of coatings were exposed through a 0.1 increment step wedge with a $10^{-3}$s flash sensitometer. A filter combination (WRATTE™ 29+18A) was used to ensure that only the infra-red sensitive grains were exposed.

The coatings were then processed in KODAK™ RA2000 Developer (diluted 1+2) at 35° C. for 30 seconds.

The results are tabulated below:

| Time delay before coating (mins) Dual melted | Speed @ Den = 4 above fog (Rel. to control) |
|---|---|
| 3 | −0.05 |
| 6 | 0 |
| 10 | −0.06 |
| 15 | −0.09 |
| 20 | −0.09 |

Figure 2:
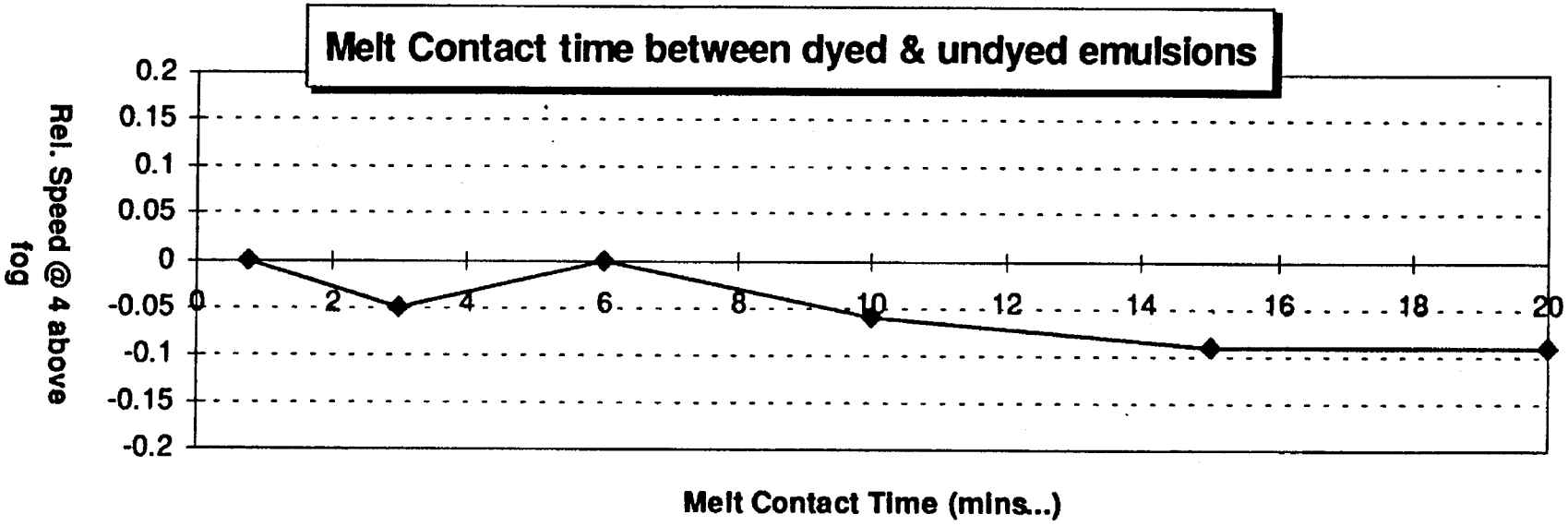

These data are shown graphically in FIG. 2 of the accompanying drawings.

The dye combination satisfies the test criteria

EXAMPLE 8

Melts E & F were prepared and coated in the same manner as described in Example 6 and used the same emulsion substrate. In this case the spectral sensitization used a combination of dyes peaking in the 670 nm region. The structures of these dyes are shown below (structures 6 and 7). The molar ratio of melt E (dyed) and melt F (undyed) was 1:4.

STRUCTURE 6

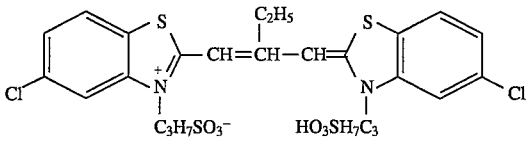

STRUCTURE 7

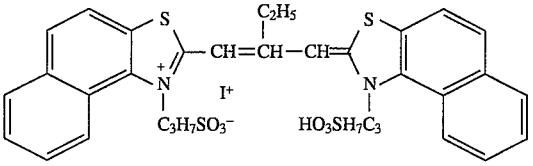

The series of coatings were exposed through a 0.1 increment step wedge with a $10^{-6}$ flash sensitometer. A WRATTE™ 29 filter was used to ensure that only the red sensitive grains were exposed.

The coatings were then processed in KODAK RA2000 Developer (diluted 1+2) at 35° C. for 30 seconds.

The results are tabulated below:

| Time delay before coating (mins) Dual melted | Speed @ Den = 4 above fog (Rel. to control) |
|---|---|
| 3 | −0.02 |
| 6 | −0.01 |
| 10 | −0.02 |
| 15 | −0.03 |
| 20 | −0.03 |

Figure 3:
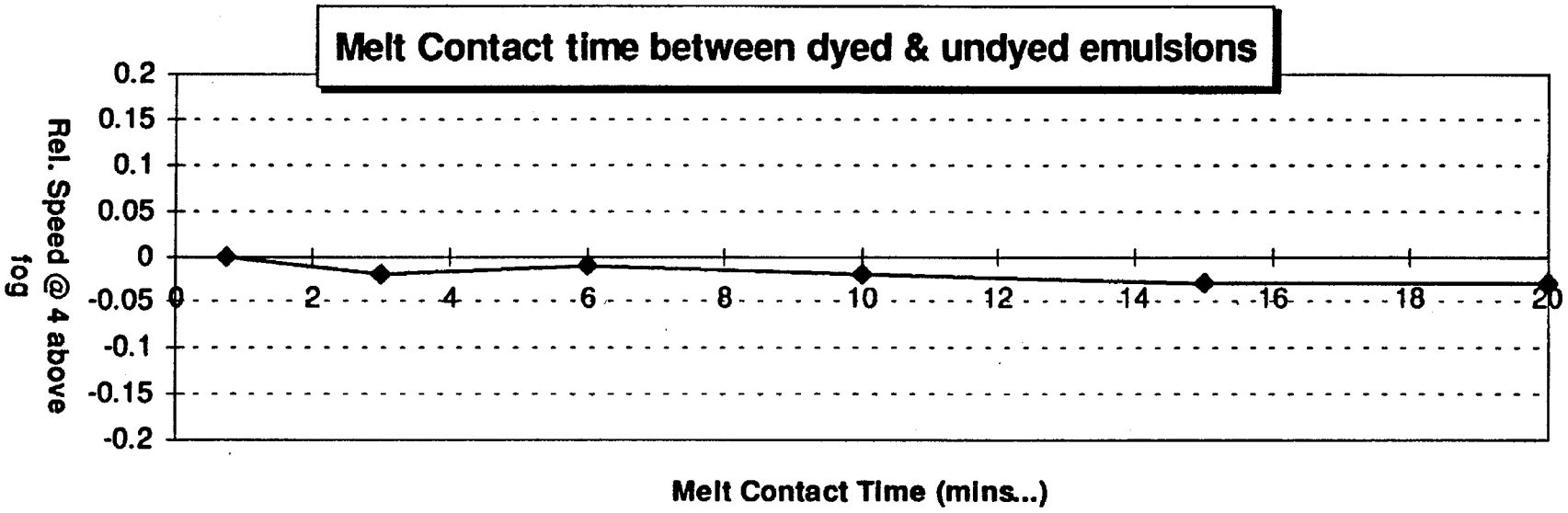

These data are shown in graphical form in FIG. 3 of the accompanying drawings.

This dye combination satisfies the test criteria.

EXAMPLE 9

Melts G & H were prepared and coated in the same manner as described in Example 6. The substrate used for both melts was a chlorobromide monodisperse cubic emulsion having an edgelength of 0.13 μm. In this case the spectral sensitization used a dye peaking in the 670 nm region. The structure of this dye is shown below (structure 8). The molar ratio of melt G (dyed) and melt H (undyed) was 1:9.

STRUCTURE 8

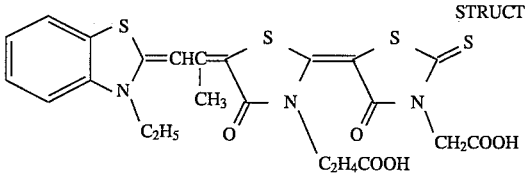

The series of coatings were exposed through a 0.1 increment step wedge with a $10^{-6}$ flash sensitometer. A WRATTE™ 29 filter was used to ensure that only the red sensitive grains were exposed.

The coatings were then processed in KODAK RA2000 Developer (diluted 1+2) at 35° C. for 30 seconds.

The results are tabulated below:

| Time delay before coating (mins) Dual melted | Speed @ Den = 4 above fog (Rel. to control) |
|---|---|
| 3 | −0.03 |
| 4 | 0.03 |
| 6 | 0 |
| 10 | −0.02 |
| 18 | −0.05 |

Figure 4:
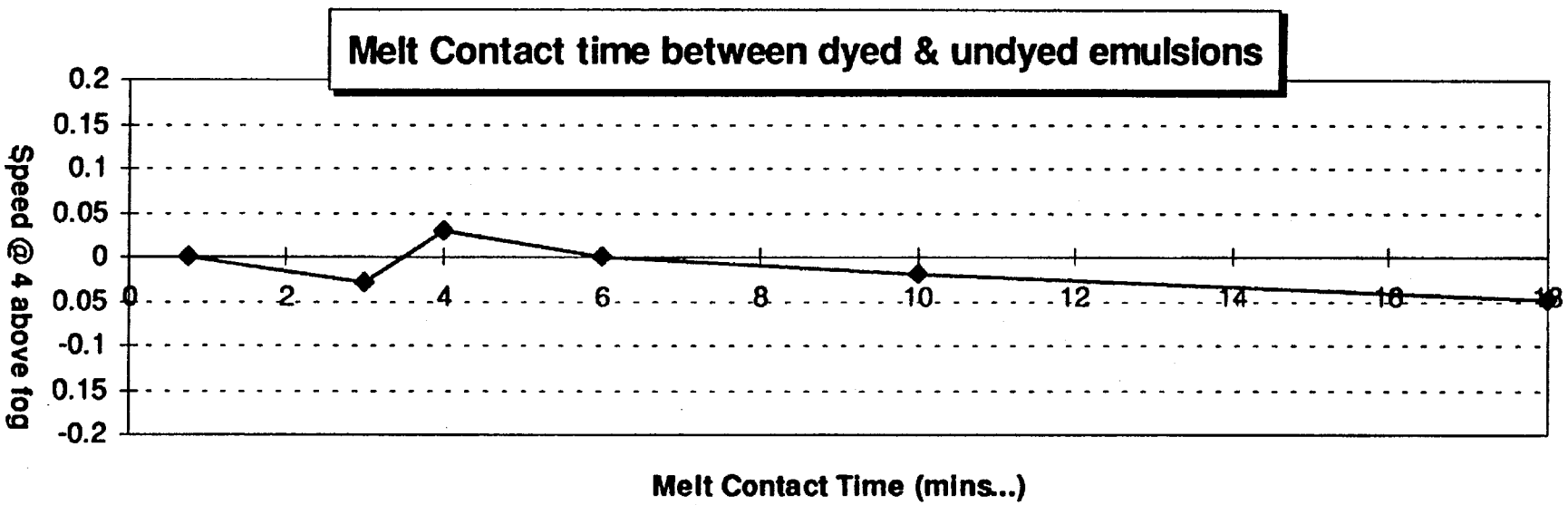

These data are shown graphically in FIG. 4 of the accompanying drawings.

This dye satisfies the test criteria.

EXAMPLE 10

Melts I & J were prepared and coated in the same manner as described in Example 6 and used the same emulsion substrate as in Example 9. In this case melt I was spectrally sensitized with a dye peaking in the 488 nm region (Structure 9) and melt J was spectrally sensitized using the dye from Example 9 (Structure 8) which peaks in the 670 nm region. The molar ratio of melt I and melt F was 1:1.

STRUCTURE 9

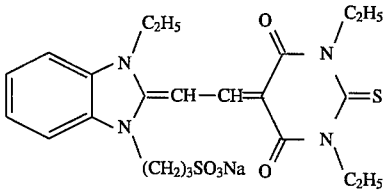

The series of coatings were exposed through a 0.1 increment step wedge with a $10^{-6}$ s flash sensitometer. A filter combination (WRATTEN™ filters 38+2B+47) was used to ensure that only the 488 nm sensitive grains were exposed.

A second set of coatings was exposed through a 0.1 increment step wedge with a $10^{-6}$ s flash sensitometer. A WRATTEN™ 29 filter was used to ensure that only the red sensitive grains were exposed.

Both sets of coatings were then processed in KODAK RA2000 Developer (diluted 1+2) at 35° C. for 30 seconds.

Part 1: the filter combination exposing the grains dyed with the spectral sensitizer shown in structure 9. The results are tabulated below:

| Time delay before coating (mins) Dual melted | Speed @ Den = 4 above fog (Rel. to control) |
|---|---|
| 3 | 0 |
| 4 | −0.01 |
| 6 | −0.02 |
| 10 | 0.02 |
| 18 | −0.02 |

Figure 5:
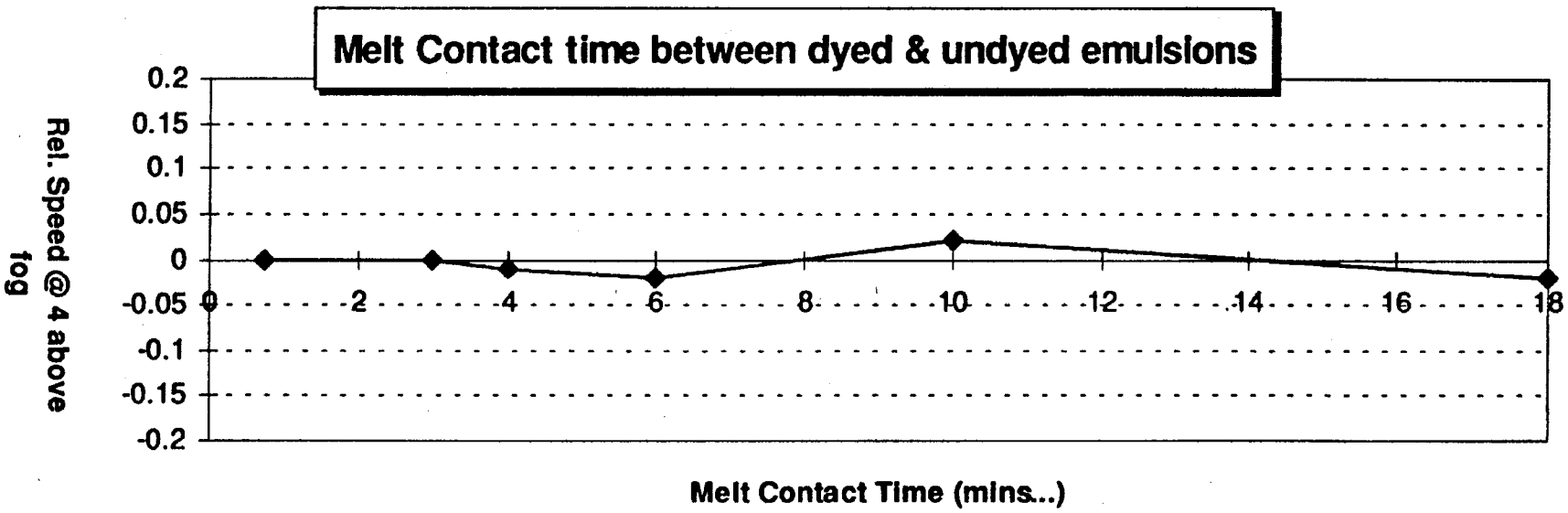

These data are shown in graphical form in FIG. 5 of the accompanying drawings.

Part 2: Results from the exposures using the WRATTEN™ 29 filter exposing the grains dyed with the spectral sensitizer shown in structure 8.

| Time delay before coating Dual melted | Speed @ Den = 4 above fog (Rel. to control) |
|---|---|
| 3 | 0.01 |
| 4 | 0 |
| 6 | 0.01 |
| 10 | 0.01 |
| 18 | 0 |

Figure 6:
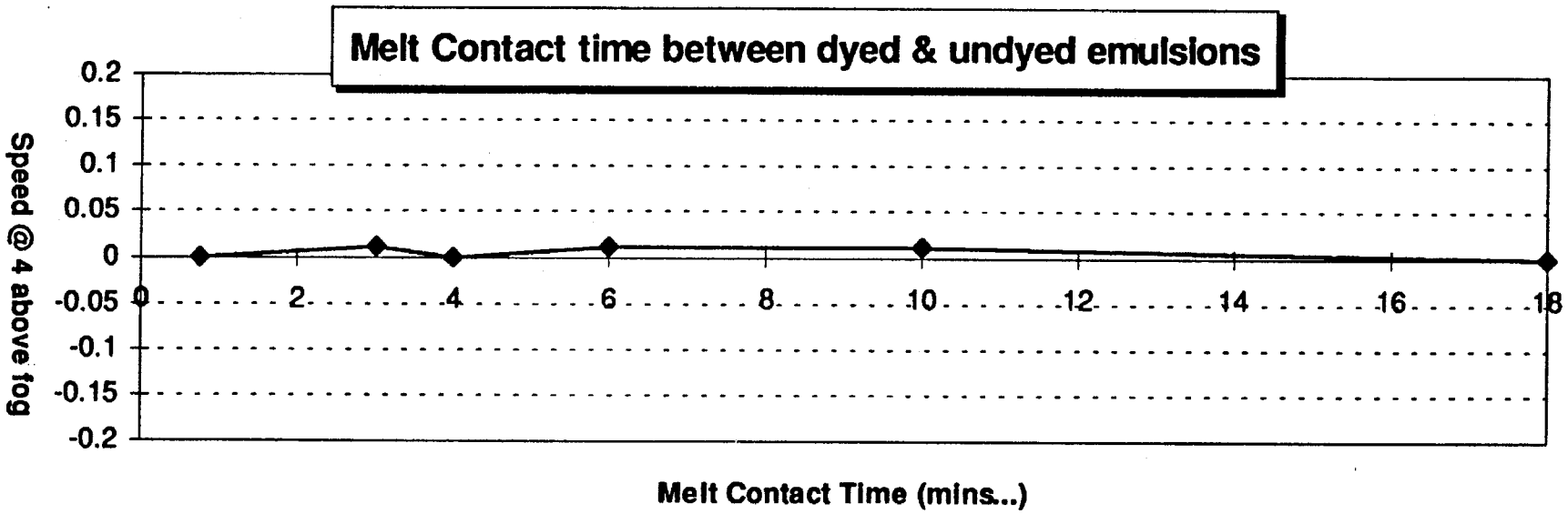

These data are shown in graphical form in FIG. 6.

Both these dyes satisfy the test criteria.

The invention has been described in detail, with particular reference to certain preferred embodiments thereof, but it should be understood that variations and modifications can be effected within the spirit and scope of the invention.

We claim:

1. A high contrast photographic material comprising a support bearing a silver halide emulsion layer; said photographic material containing, in said emulsion layer or an adjacent hydrophilic colloid layer, a hydrazide nucleating agent and said photographic material being characterised in that said emulsion layer comprises silver halide grains which are spectrally sensitised with a non-desorbing sensitising dye and silver halide grains which are not spectrally sensitised; both said spectrally sensitised silver halide grains and said non-spectrally-sensitised silver halide grains contributing, as a consequence of the presence of said hydrazide nucleating agent in said photographic material, to the visible silver image that is produced by imagewise exposure and development of said photographic material.

2. A photographic material as claimed in claim 1 which contains, in said emulsion layer or an adjacent hydrophilic colloid layer, a booster compound rendering the material developable in a developer solution having a pH below 11.

3. A photographic material as claimed in claim 2 in which said booster compound is an amine booster.

4. A photographic material as claimed in claim 3 wherein said amine booster:

(1) comprises at least one secondary or tertiary amino group, (2) contains within its structure a group comprised of at least three repeating ethyleneoxy units, and (3) has an n-octanol/water partition coefficient (log P) of at least one, log P being defined by the formula:

$$\log P = \log \frac{[X_{octanol}]}{[X_{water}]}$$

wherein X is the concentration of the amino compound.

5. A photographic material as claimed in claim 2 in which said booster compound has the general formula:

$$Y((X)_n—A—B)_m$$

wherein

Y is a group which adsorbs to silver halide,

X is a bivalent linking group composed of hydrogen, carbon, nitrogen and sulphur atoms, A is a bivalent linking group, B is an amino group which may be substituted, an ammonium group or a nitrogen-containing heterocyclic group, m is 1, 2 or 3 and n is 0 or 1, or the general formula:

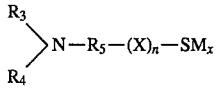

wherein $R_3$ and $R_4$ are each hydrogen or an aliphatic group, or $R_3$ and $R_4$ may together form a ring, $R_5$ is a bivalent aliphatic group, X is a bivalent heterocyclic ring having at least one nitrogen, oxygen or sulphur atom as heteroatom, n is 0 or 1, and M is hydrogen or an alkali metal atom, an alkaline earth metal atom, a quaternary ammonium group, quaternary phosphonium group or an amidino group, x is 1 when M is a divalent atom; said compound optionally being in the form of an addition salt.

6. A photographic material as claimed in claim 1 in which both types of grain are chemically sensitised.

7. A photographic material as claimed in claim 1 in which both types of grain comprise 50–100% silver chloride.

8. A photographic material as claimed in claim 1 in which the silver halide grains are doped with one or more Group VIII metals at levels in the range $10^{-9}$ to $10^{-3}$, mole metal per mole of silver.

9. A photographic material as claimed in claim 1 in which the size of the grains ranges independently from 0.05 to 1.0 micron in equivalent circle diameter.

10. A photographic material as claimed in claim 1 in which said emulsion layer contains grains sensitised to differing regions of the spectrum.

* * * * *